US005742969A

United States Patent [19]

Thomas et al.

[11] Patent Number: 5,742,969

[45] Date of Patent: Apr. 28, 1998

[54] DISPOSAL COMPACT APPARATUS FOR REMOVING LINT FROM CLOTHING

[76] Inventors: Andrew P. Thomas, 803 E. Jennifer Ct., Arlington Hts., Ill. 60004; Mark J. Pociejewski, 710 E. Algonquin, Arlington Hts., Ill. 60005

[21] Appl. No.: 719,783

[22] Filed: Sep. 25, 1996

[51] Int. Cl.[6] ..... A46B 15/00

[52] U.S. Cl. ..... 15/104.002

[58] Field of Search ..... 15/104.002

[56] References Cited

U.S. PATENT DOCUMENTS

| | | | |
|---|---|---|---|
| 3,029,453 | 4/1962 | Norman | 15/104.002 |
| 3,082,453 | 3/1963 | Mutchler et al. | 15/104.002 |
| 3,299,461 | 1/1967 | Marks | 15/104.002 |
| 3,389,416 | 6/1968 | Timms | 15/104.002 |
| 3,864,993 | 2/1975 | Hovind | 15/104.002 |

*Primary Examiner*—Terrence Till
*Attorney, Agent, or Firm*—Charles F. Lind

[57] ABSTRACT

The disclosed particle removing device is formed as a thin flexible generally flat loop sheet, with a layer of adhesive covering one sheet face while the other face is substantially plain, and a quick release backer sheet covers the adhesive layer on the loop sheet 12 prior to use. The particle removing device is reconfigured from its flat storage condition to a three-dimensional loop use configuration, with the adhesive layer exposed and on the outside face of the loop, by peeling off the backer sheet to expose the underlying adhesive layer and curling the loop sheet on itself to connect its opposite ends together at a small lapped connection area. The user can then fit his/her open hand into the loop to pat or roll the loop adhesive layer against or along the surface to be cleaned.

7 Claims, 1 Drawing Sheet

DISPOSAL COMPACT APPARATUS FOR REMOVING LINT FROM CLOTHING

BACKGROUND OF THE INVENTION

Lint, dust, dandruff, hair, fuzz and many other unwanted particles frequently collect on fabric surfaces, particularly clothing, and render such unsightly even though the fabric otherwise is clean and usable. Larger or isolated particles can individually be picked off of the fabric surface, between one's fingers and thumb, but practically such is only possible when few particles are involved. Tools, devices, systems or the like have thus been devised and are commercially available and/or used for clearing larger or more densely covered areas.

Brushes utilize flexible bristles held within or by rigid framing, thereby defining a three-dimensional structure of substantial size. Roller devices are also comprised of a rigid three-dimensional framing for supporting and rotating a roll having an adhesive coated cylindrical surface, which can be moved along the fabric surface and over the particles for removal. While such framing and/or structures can frequently be shifted between an operative orientation of one size and a more compact different orientation suited for storage, none can be completely collapsed to a compact almost two-dimensional and soft or flexible unit for easy storage and/or portable carriage.

Scrubbers are also available, but most must be wetted by either a solvent or water during its use for removing the particles, which carries a risk of damaging or spotting the fabric.

Further, adhesive tape has been used by sticking it against the fabric surface, to bond to and remove the underlying particle when the tape is pulled off. However, the use of tape with only two available hands is both challenging and frustrating as the inadequately supported tape frequently curls or twists and sticks to itself during the manipulation needed to remove the tape from its dispensing roll, to cut it to length, and then to handle it accurately while blotting it against the fabric so as to remove the particles. Further, the adhesive tape roll and dispensing device can be rigid and bulky.

Thus, known commercially available and used particle removal devices or systems lack acceptance or serve the needs of a lightly packed business traveler, as such are rigid and/or bulky and/or costly and reusable and/or risky to use.

SUMMARY OF THE INVENTION

This invention relates to and an object of this invention is to provide a device for removing small particles such as lint, hair, etc. from fabric surfaces.

A more specific object of this invention is to provide a particle removal device that is of lightweight, compact, soft, flexible, durable and disposable structures, making it suited for portable carriage to remote locations, and then safe and easy use in removing particles from a fabric garment or the like by a lightly packed business traveler, or from a fabric at many remote locations, such as furniture cushions or car upholstery.

BRIEF DESCRIPTION OF THE DRAWINGS

These and other objects, features or advantages of the invention will be more fully understood and appreciated after reviewing the following specification which includes as a part thereof the accompanying drawings, wherein.

DETAILED DESCRIPTION OF A PREFERRED EMBODIMENT OF THE INVENTION

Figure 1:
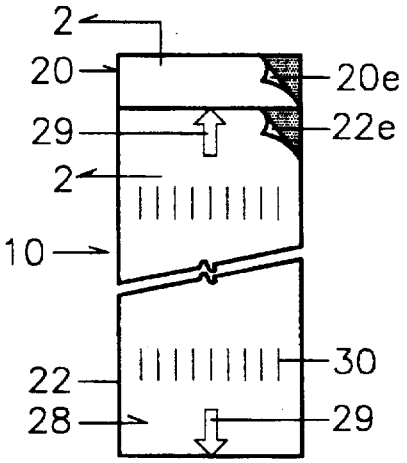
FIG. 1 is a plan view of the particle removal device in a flat storage or carriage mode prior to its use, illustrating a loop sheet and backer sheets adhered together.
Figure 2:
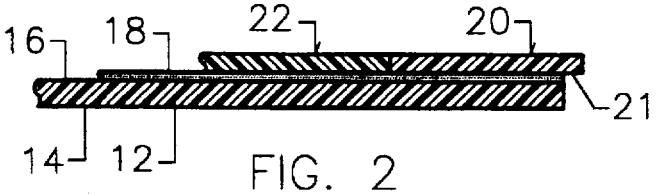
FIG. 2 is an enlarged sectional view as seen generally from line 2—2 in FIG. 1.
Figure 3:
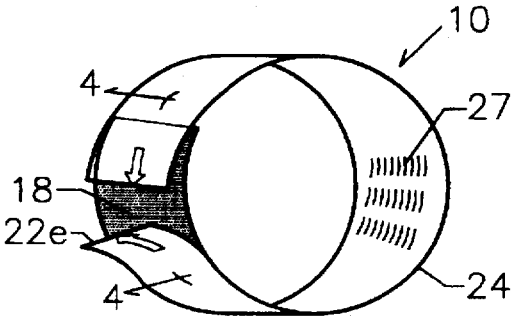
FIG. 3 is a perspective view of the particle removal device in a pre-use mode, with one backer sheet removed and the loop sheet with its ends overlapped and connected as an operative loop and with another backer sheet only partly removed to expose a sticky adhesive layer on the outer face of the operative loop.
Figure 4:
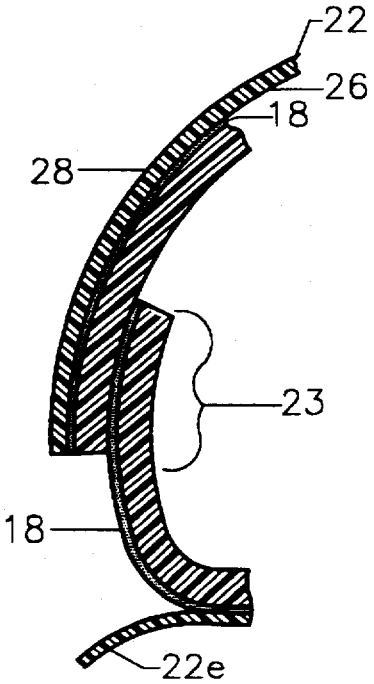
FIG. 4 is an enlarged sectional view as seen generally from line 4—4 in FIG. 3.
Figure 5:
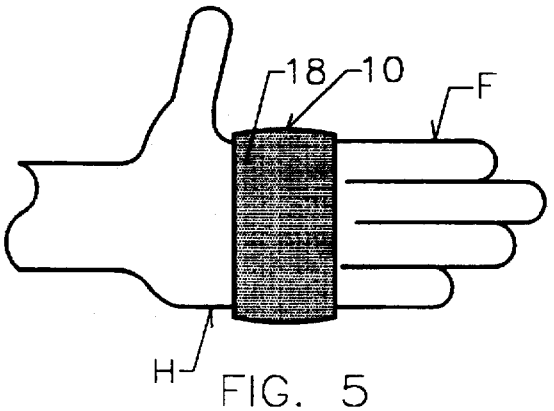
FIG. 5 is an elevational view of the device as it might be positioned on a user's hand for patting against or rolling along the fabric to be cleared of particles.

A particle removing device 10 is illustrated in FIGS. 1–5, being comprised of a thin flexible generally flat sheet or substrate 12 having opposed faces 14 and 16, with a layer of sticky material or adhesive 18 uniformly applied on or covering one face 16 while the other face 14 is substantially plain; and protective backer sheets 20 and 22 overlie and cover the adhesive layer 18 on the sheet 12, but are of conventional design with release agent surfaces to be easily removable from the adhesive layer by merely peeling each sheet off of the sheet 12 from an edge, as illustrated at **20*e* and 22*e* in FIGS. 1, 3 and 4**.

To ease initial backer sheet gripping for peeling it off, the backer sheet edge can be projected a small distance, possibly between 1/32"–1/8", as at 21 in FIG. 2 beyond the edge of the underlying sheet 12. Otherwise, the sheets 12 and 20,22 can be separated along any corner edge by picking crosswise to the edges, which causes the sheets to break apart to expose an individual sheet that can then be pinched for pulling it off.

To use the particle removing device 10, the backer sheet 20 would first be removed to expose the underlying adhesive layer 18 on the end of sheet 12. The loop sheet 12 would then be curled around a generous radius of curvature with face 14 being on the inside to overlap the opposite sheet end against the exposed adhesive layer, which when pressed together bond as at lapped connection area 23 for forming a three-dimensional loop 24 (FIG. 3) from the originally flat sheet 12. The backer sheet 22 could then be removed, to expose the adhesive layer 18 on the outside face of the loop.

The sheet 12 would be rectangular in shape, sized between 2"–4" wide by between 8"–12" long, preferably about 3" by 11", with the lapped connection area 23 being between ½"–2", preferably about 1". This could provides a loop 24 having a circumference of between possibly 6" and 11", suited to be positioned onto and over the palm region of an open hand H or the straightened fingers F of a user (see FIG. 5). The user could then pat the sticky outside adhesive face 18 of the loop 24 against the fabric surface and over the particles to be removed, or could move the hand along the fabric surface and allow the loop to roll along the surface, rotating on the user's hand.

The sheet or substrate 12 can be formed of economical sheet material, such as paper, having the desired physical properties, for example of moderate stiffness so as not twist or curl on itself when suspended from only one end and to form the stable three-dimensional loop 24, but yet being flexible enough with its thin cross-section to allow it to be rolled over a large radius of curvature to have its opposite ends overlapped and connected. Paper sheets having thicknesses between 0.005"–0.1" have proven to be acceptable, with an approximate thickness of 0.01" being preferred.

Further, face 14 of sheet 12 preferably would be absorbent to accept commercial printing with ink or the like, so that instructive or advertising messages 27 can be presented on this face, adding to the overall appeal of providing such devices.

The backer sheets 20, 22 overlying and covering the adhesive layer 18 likewise can be of economical paper or plastic, with face 26 coated or treated with a release agent such as silicon to allow only moderate bonding to the adhesive layer, so that each sheet 20, 22 could be easily peeled off by pulling on any corner edge. Further, the opposite sheet face 28 should accept commercial printing thereon, so that instructive or advertising messages can be presented on this face.

Specifically, markings such as arrows 29 can be provided on the face 26 at the end of the backer sheet 22 to advise the user where to line up the sheet ends when forming the loop. Also, instructions how to use the device can be provided on the face as illustrated at markings 30.

The disclosed particle removal device 10 being of paper is thus lightweight, soft, flexible, durable and disposable, and flat and compact before use, particularly suited for portable carriage in lightweight soft luggage frequently preferred by lightly packed business travelers. The adhesive is safe for most fabrics, and would stick to and remove particles loosely adhered to the fabric in removing such particles. The device can be easily assembled from the flat configuration to the loop configuration 24, as the sheet 12 is flexible but yet resistant to curling on itself. The device needs no electrical power or solvents, and can be easily used at remote locations.

While separate backer sheets 20 and 22 have been illustrated, a single sheet (not shown) could be used instead, if care were used in peeling only part of the sheet off initially in converting the flat sheet 12 to the loop 24 for minimizing the possibility of the sticky adhesive covered face 18 accidentally becoming stuck against nearby structures, including itself at several locations.

While a specific embodiment has been illustrated, it will be obvious that minor changes could be made therefrom without departing from the spirit of the invention. Accordingly, the invention is to be determined by the scope of the following claims.

What is claimed is:

1. A device for removing loose particles from a fabric surface, comprising a thin flexible generally flat sheet having opposed faces, with a layer of sticky adhesive uniformly covering one of the faces while the other face is substantially plain, first and second quick release backer sheets together overlying and covering the adhesive layer on the sheet, the first backer sheet overlying and covering a portion of the adhesive layer on only a limited connection area adjacent only one end of the sheet and the second backer sheet overlying and covering the remainder of the adhesive layer on the rest of the sheet, the device in this flat configuration being suited for compact storage or carriage prior to use and being converted by a user from a flat configuration by first removing the first backer sheet to expose the adhesive layer at the connection area and then curling the sheet with the plain face on the inside and overlapping the plain face adjacent the opposite end of the sheet with the exposed adhesive layer to bond the opposite sheet ends together for defining a three-dimensional loop with the plain face on the inside thereof and sized generally to be fitted over the open hand and straightened fingers of the user, and then removing the second backer sheet to expose the remainder of the adhesive layer on the outside face of the three-dimensional loop suited to be patted or rolled against the fabric surface.

2. A particle removing device according to claim 1, further comprising the sheet being rectangular in shape, sized between 2"–4" wide by between 8"–12" long, with the lapped connection area being between ½"–2", providing thereby the three-dimensional loop having a circumference of between 61" and 11".

3. A particle removing device according to claim 1, further comprising the sheet being formed of paper having stiffness causing it to remain generally flat and not twist on itself when suspended from only one end and before intentionally being curved on itself to form the three-dimensional loop.

4. A particle removing device according to claim 3, further comprising the sheet having thicknesses between 0.005"–0.1".

5. A particle removing device according to claim 3, further comprising the sheet being absorbent on said plain face to accept commercial printing with ink, so that instructive or advertising messages can be presented on this face.

6. A particle removing device according to claim 1, further comprising the backer sheets being of paper with one sheet face treated with a release agent to define quick release bonding to the adhesive layer and with an opposite sheet face absorbent to accept commercial printing thereon, and the printing on said other face comprising instructive messages having markings to advise the user how and where to line up the sheet ends for forming the three-dimensional loop.

7. A particle removing device according to claim 1, further comprising the backer sheets each having an edge projecting a small distance beyond the edge of the underlying sheet suited to grip for peeling the backer sheets easily off of the underlying sheet.

* * * * *